US005308258A

United States Patent [19]

Hatsios

[11] Patent Number: 5,308,258

[45] Date of Patent: May 3, 1994

[54] PLANAR MODULAR INTERCONNECT SYSTEM

[75] Inventor: John G. Hatsios, Poughkeepsie, N.Y.

[73] Assignee: International Business Machines Corporation, Armonk, N.Y.

[21] Appl. No.: 11,030

[22] Filed: Jan. 29, 1993

[51] Int. Cl.[5] ..... H01R 13/28

[52] U.S. Cl. ..... 439/284; 439/397; 439/465; 439/731

[58] Field of Search ..... 439/284–295, 439/397, 400, 465, 731, 678

[56] References Cited

U.S. PATENT DOCUMENTS

| | | | |
|---|---|---|---|
| 3,157,448 | 11/1964 | Crimmons et al. . | |
| 3,188,600 | 6/1965 | Woofter et al. . | |
| 3,337,838 | 8/1967 | Damiano et al. . | |
| 3,648,219 | 3/1972 | Goldman . | |
| 3,676,833 | 7/1972 | Johnson . | |
| 4,083,617 | 4/1978 | Wyatt . | |
| 4,097,106 | 6/1978 | Over et al. . | |
| 4,315,663 | 2/1982 | Olsson | 439/398 |
| 4,537,456 | 8/1985 | Brown et al. . | |
| 4,734,052 | 3/1988 | Vandame | 439/293 |

FOREIGN PATENT DOCUMENTS 1455081 11/1976 United Kingdom .

OTHER PUBLICATIONS

IBM Techncial Disclosure Bulletin, vol. 15, No. 1, p. 108, Linear Array Connecter K. R. Dust, Jun. 1972.

*Primary Examiner*—Neil Abrams

*Attorney, Agent, or Firm*—Floyd A. Gonzalez; Aziz M. Ahsan

[57] ABSTRACT

An electrical connector is provided with electrical contacts comprising three contact zones or regions. The primary contact region is planar and parallel with the axis of insertion when two identical hermaphroditic connectors are mated. The tip of the contact assembly is formed to create a second contact zone and a third contact zone is formed at the same orientation as the second contact zone and disposed to be engaged by the second contact zone of the mating contact assembly. The housing of the connector is keyed to permit connection only with an identically keyed connector housing. The connector is provided with a strain relief formed integrally with the housing to resist the pulling of the conductors from the connector. The contact assembly engages the wire in the conductor when final assembly occurs, by means of a double insulation displacement contact.

20 Claims, 5 Drawing Sheets

10
12
13
15
16
22
24
26
28
30
32
34
36
38
40
42
44
46
48
50
52
54
66
68
70
72
74
76
98
A
B

FIG. 7
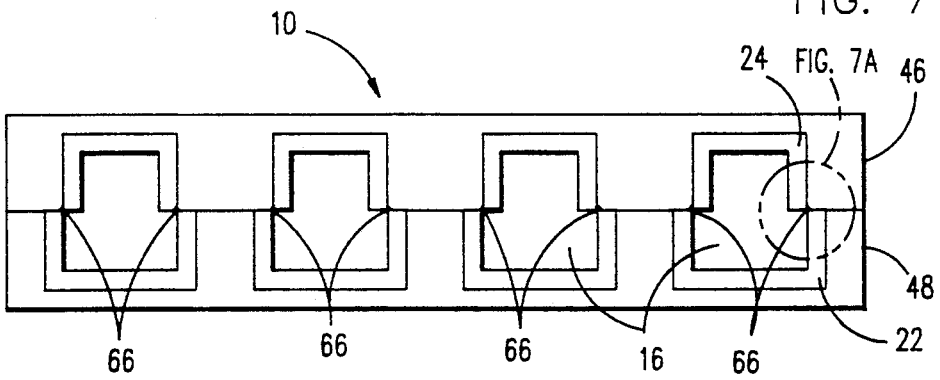
FIG. 7A
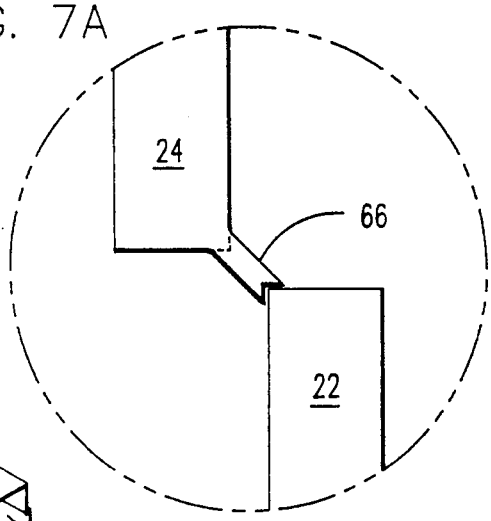
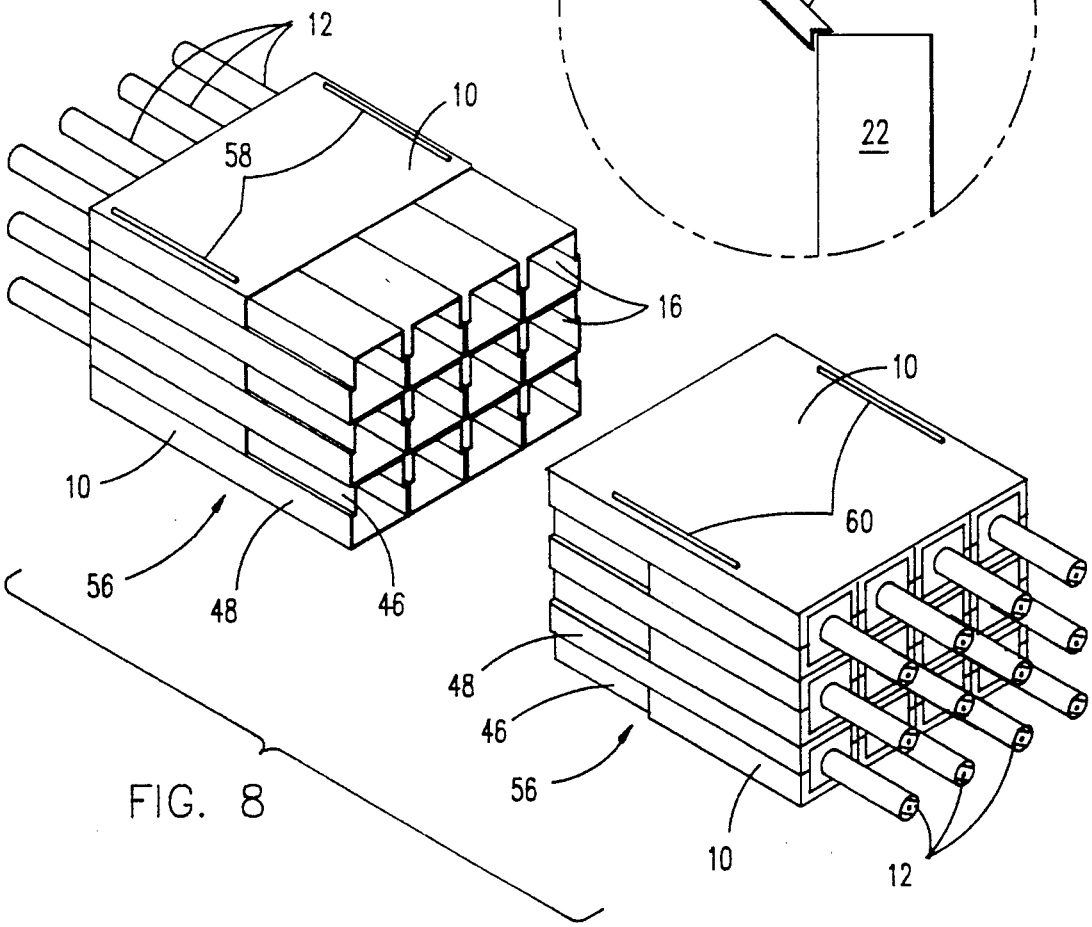
FIG. 8

PLANAR MODULAR INTERCONNECT SYSTEM

FIELD OF THE INVENTION

This invention relates to the field of electrical connectors and more specifically to hermaphroditic connectors which comprise a pair of identical assemblies which are mateable with each other to form a single connector apparatus.

BACKGROUND OF THE INVENTION

Hermaphroditic electrical connectors are desirable because the mating nature of the connectors is such that only one design of the connector element need be manufactured and then multiple connector elements may be used by merely reversing them and inserting them into a second identical connector. Connectors of the hermaphroditic type are typically used in cases where there is a requirement to assemble and disassemble the connector or to make an electrical connection and then disconnect the electrical connection on a repeated basis. The connector must be reliable and provide a high quality electrical contact when assembled. The electrical connector housing or module must capture the wires which extend from the connector housing and at the same time provide a strain relief to insure that the electrical wires are properly maintained in contact with the electrical contact elements within the housing.

OBJECTS OF THE INVENTION

Reliable electrical contact is the paramount object of this invention.

Another object of the invention is to simplify the assembly of the connector.

An additional object of the invention is to provide a secondary electrical contact zone on each of the electrical contacts to insure reliable electrical contact between the contacts when assembled.

Another object of the invention is to establish electrical contact between the electrical contacts of the connector and the electrical wire as assembly of the shells of the connector occurs.

A still further object of the invention is to form a double insulation displacement contact between the electrical contact and the wire within the insulation of the electrical conductor.

It is a still further object of the invention to engage the wire with an insulation displacement strain relief upon the assembly of the connector shells.

The foregoing objects of the invention and requirements of the electrical connector are accomplished by providing a flat planar contact surface formed of an electrical conductive material such as, for example, copper and inclining that surface relative to the axis of insertion of the connector and extending through and intersecting the center line of the module. Secondly, a region of planar surface oriented to intersect with the plane of the first planar contact surface but oriented at a greater inclination to the axis of insertion is formed at the end of the engagement surface most displaced at the opening of the connector housing.

A similarly oriented region is formed into the nose or the end of the conductor forming the contact plane, closest to the opening of the connector housing. The three contact zones on each connector contact are further supported by additional planar electrically conductive material formed to complete a loop by being bent back alongside the first contact zone. A first end of the just described loop is fixedly attached to an intermediate portion of the electrically conductive planar material thereby forming the loop. The other end is further extended and formed into an insulation displacement engaging member which is bent to be oriented approximately perpendicular to the axis of an electrical conductor inserted into the connect module housing. A further flat member of the same material is likewise fixed at the joining point previously described and the distal end thereof formed into a second insulation displacement contact facing the first insulation displacement contact and displaced therefrom.

When the electrical contact is positioned into and contained within the module housing after assembly, the two insulation displacement contacts are forced toward each other displacing the insulation on the wire and making physical contact with the wire in the center of the conductor and insulation.

For each contact in the electrical connector, two sharp edged metal members are fixed to the interior of the housing, one in each shell of the housing to be forced toward each other and to engage the insulation surrounding the electrical conductor of the insulated wire entering the housing. The metal devices with sharp edges form a strain relief when engaged with the insulation of the wire to prevent the wire from being pulled from the housing under normal stresses.

The individual modules containing a relatively small number of electrical contacts may be stacked and interlocked to form larger connector assemblies. Where it is desired to permit only a uniquely keyed module to be inserted into a similarly uniquely keyed module thereby preventing undesired interconnections, the regions of mating engagement may be relieved or removed to provide a unique keying arrangement preventing unintended electrical connections with similar modules.

A better understanding of the invention may be had by referring to the drawings and the detailed description of the preferred embodiment of the best mode contemplated by the inventors, to follow.

DRAWINGS

FIGS. 7 and 7A illustrate the keying arrangement which may be implemented to insure that only compatible electrical connections are made.

FIG. 8 illustrates stacked connector modules forming a connector assembly.

DETAILED DESCRIPTION OF THE PREFERRED EMBODIMENT OF THE BEST MODE CONTEMPLATED BY THE INVENTORS FOR CARRYING OUT THE INVENTION

Figure 1:
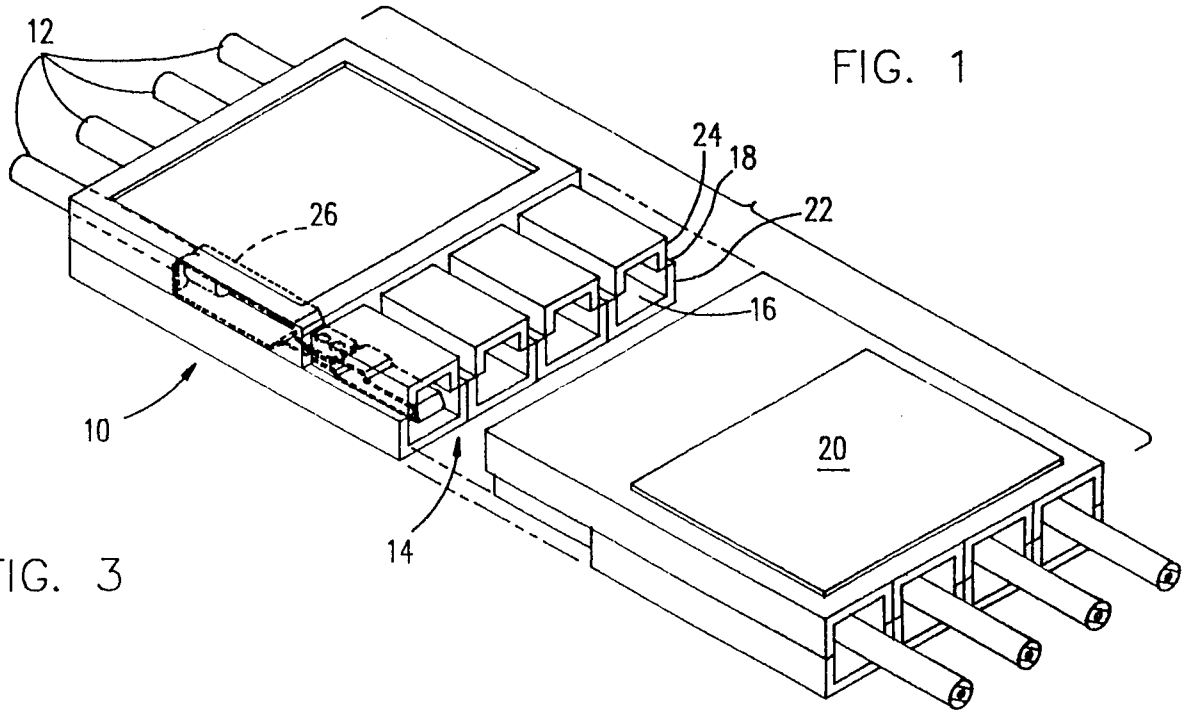
FIG. 1 illustrates connector modules of the invention in an aligned but not engaged position.

With reference now to FIG. 1 of the drawings, the connection module 10 is illustrated in a four connector wide configuration. Module 10 accommodates the connecting of four conductors 12 extending into the rear of module 10. The opposite face of module 10 or front face 14 is illustrated having four openings and four structural configurations which will permit the mating of the structural configurations 18 with identical structural configurations on a second module 20 when module 20 is reversed from the orientation of module 10. The structural configurations 18 of module 10 are formed by two U-channels 22 and 24, one of which 24, is narrower than the other 22 by the thickness of the walls of the channels 22 and 24. Further the channel 24 has a height which is substantially the same as the interior depth of channel 22 where a channel 22 may be inserted over and surround channel 24 and a mating channel 24 may be inserted within the channel 22 of module 10.

Contained within the chambers formed by the walls of channels 22, 24 and within the module housing 10, is the electrical contact assembly 26. One electrical contact assembly is resident for each electrical conductor 12 extending to within the module housing 10.

Figure 2:
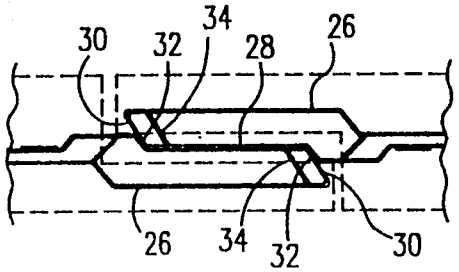
FIG. 2 is a side view of mated planar contacts of the invention.
Figure 3:
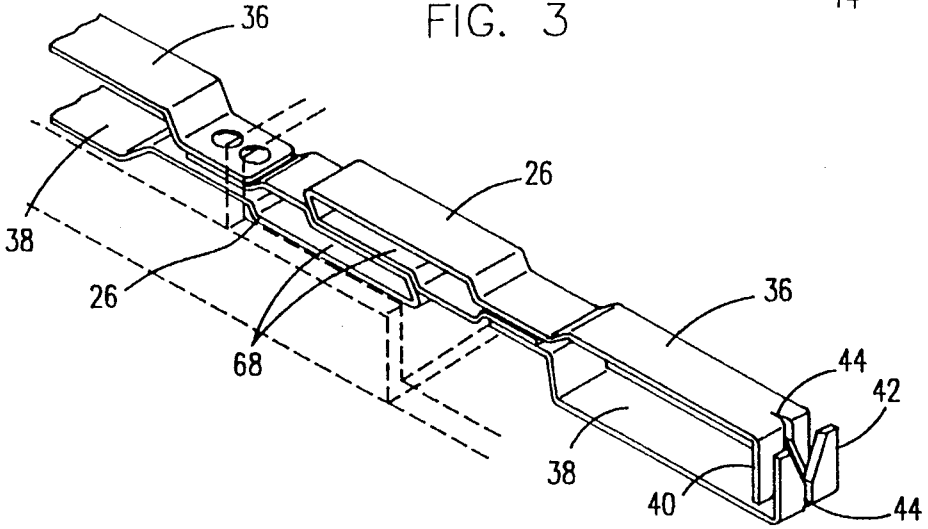
FIG. 3 is a perspective of the mated contacts.

A better understanding of the construction of the electrical contact assembly 26 may be had by referring to FIGS. 2 and 3. Electrical contact assemblies 26 are preferably formed from a thin narrow band of electrically conductive material such as copper alloy, beryllium copper. Should the need arise for specialized treatment, the copper alloy may be appropriately plated with other metals which will either provide an enhanced contact or a corrosion resistant contact such as silver or gold. Copper alloys are normally sufficient and additional platings are not normally required.

The contact conductor strip may then be bent and formed to provide a plurality of contact zones. The contact zones are typically planar in nature to provide a large engaging surface on each to insure minimum resistance and maximum contact. A large contact zone 28 is also the primary contact zone of the contact assembly 26. The large contact zone lies generally parallel with the axial movement of engagement and is typically the full width of the contact assembly while extending for a length equal to several widths of the contact assembly. The large contact zone 28 will engage in a face-to-face engagement with the large contact zone 28 of the mating contact assembly 26. The two large contact zones 28 will slide over each other until the connection module 10 is fully engaged with the second module 20.

At the end of the contact assembly 26 which extends closest to the openings 16 in connection module 10, a nose contact zone 30 is formed by bending the copper strip forming contact assembly 26 to present a flat zone disposed at an angle to the axis of insertion of the two modules 10, 20 into the other respectively. The orientation of zone 30 is such that if it engages the identical surface 30 of the mating contact assembly 26, it will act to spread the two contact assemblies 26 sufficiently to let one contact assembly 26 slide past the other contact assembly 26 thereby engaging the large contact zones 28 on each of the contact assemblies 26. A third contact zone is formed with substantially the same angular orientation with respect to the large contact zone 28 as is present with respect to the nose contact zone 30. The further contact zone designated as a stop contact zone 32 extends from the plane of the large contact zone 28 into the path of the nose contact zone 30 of the mating contact assembly 26. As the two contact assemblies 26 are forced into engagement and the respective large contact zones 28 are in face-to-face relation with each other, continued insertion of one of the modules 10, 20 into the other module 20, 10 will cause the nose contact zone 30 to come into an abutting relationship with the stop contact zones 32 of the contact assemblies 26. This abutting relationship will serve to stop any further insertion movement but in the event that one of the nose contact zones 30 and the stop contact zone 32 of the opposite mated contact assembly 26 is so forcibly engaged that there is a camming action to spread the large contact zones 28, the physical contact between the nose contact zone 30 and the stop contact zone 32 will insure electrical connection. Under ideal manufacturing and assembly conditions, all three contact zones, 28, 30, 32 on one of the contact assemblies 26 will be engaged with the corresponding engaging surface forming the corresponding engaging contact zone 28, 32, 30.

A tab member 34 is preferably pierced and bent to engage the inner surface of the contact assembly 26 and thereby maintain the contact assembly 26 in a spread configuration preventing collapse of the contact assembly 26 upon insertion and engagement with the mating contact assembly 26.

Either formed as a continuation of the contact assembly 26 or attached thereto by conventional attaching means such as riveting, spot welding or soldering is a pair of legs 36 and 38. The legs 36 and 38 terminate in a portion formed at a generally right angle to legs 36 and 38. The end 40 is attached to and formed as a portion 40 of leg 36. In a similar manner, portion 42 is attached to and is a part of leg 38. Both of the end portions 40, 42 are formed to include a generally V-shaped channel terminating in a narrow slot 44. The slot 44 is dimensioned to have a width at its narrowest point slightly smaller than the diameter of the electrical wire 13 encased within the insulation 15 forming the conductor 12. Leg 36 and leg 38 can be joined prior to inserting the assembly within shells 46, 48 or openings could be left in shells 46, 48 for the joining of the legs 36, 38 after assembly of shells 46, 48.

The V-channel and slot 44 will cut through the insulation 15 and make contact with the wire in the center of the insulated conductor 12 to establish electrical contact between the wire 13 and the contact assembly 26. The displacement of the insulation 15 is accomplished by the double insulation displacement contact formed in the shape of the V-channel 44. One of the insulation displacement contacts engages the insulation 15 and wire 13 from opposite directions thus insuring that the electrical contact is made and that it is a reliable electrical contact between the wire 13 and the contact assembly 26. The forces causing the engagement of the insulation displacement contacts in the shape of the channels 44 is derived from the assembling of the two shells 46 and 48 which form the enclosure the connector module 10 as best observed in FIG. 4.

Figure 11:
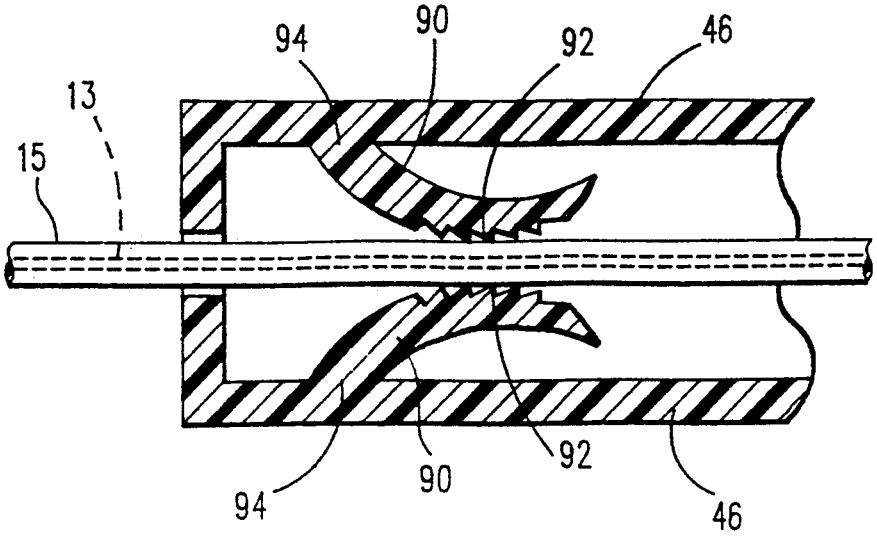
FIGS. 11 and 12 are sectional views of different strain reliefs of the invention.
Figure 12:
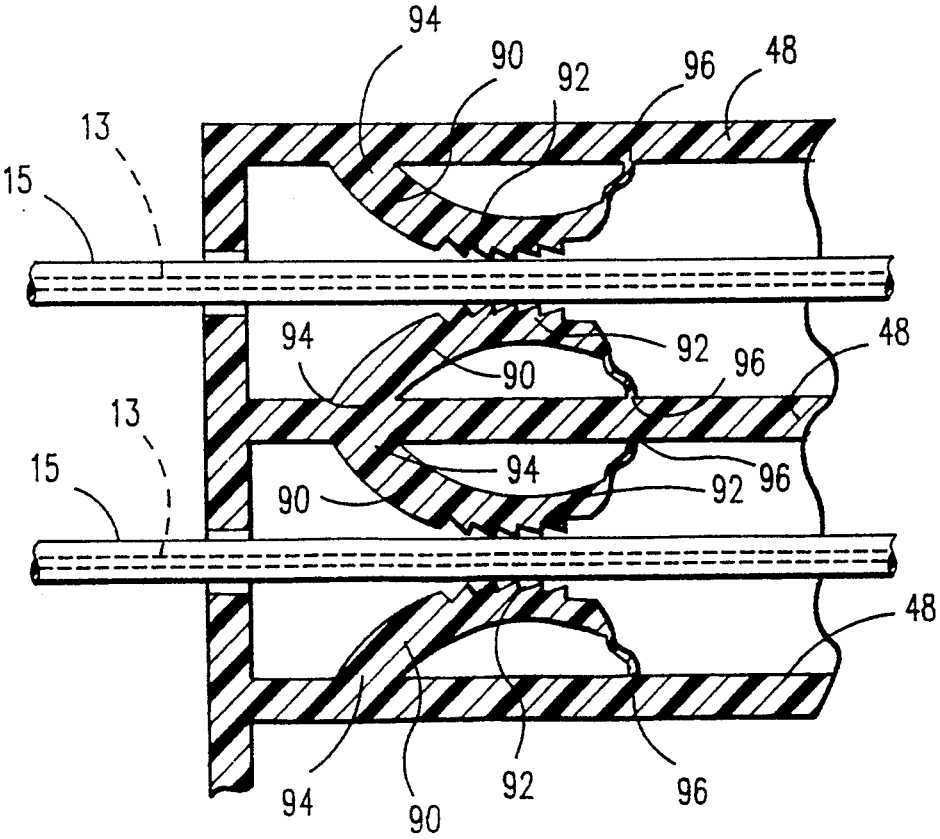

The conductors 12 are trapped and restrained within the connection module 10 by means of a strain relief. The strain relief can be of a double VII blade geometry as in FIGS. 5 and 6 or a double compression arch 90 as shown in FIGS. 11 and 12, where the restraints 50 in FIGS. 5 and 6 or 90 in FIGS. 11 and 12 extend from the interior of the top shell 46 and bottom shell 48 or horizontally within both shells as shown in FIG. 12. The restraints 50, 90 are each part of the shells 46, 48 and of the same mold and material as that of the shells 46, 48. The notch 52 of strain relief 50 is further provided with a sharpened edge 54 which will engage the insulation 15 surrounding wire 13. As the two shells 46, 48 are forced together to form the connection module 10, the sharpened edges 54 will compress the insulation 15 but will not cut through the insulation 15. This will prevent the conductors 12 from being pulled from the connection module under reasonable forces. The arch restraints 90 are similarly provided with engagement surfaces for engaging and holding the insulation 15 surrounding the wire 13. The engagement surface of the arches 90 comprise a series of serrations 92 disposed transverse to the axis of the wire 13. The serrations will engage the exterior of the insulation 15 and deform it to create a grip on the conductor 12. A force on the conductor 12 will act to compress the base of the arch restraint and to increase the force with which the restraint engages the conductor, thereby increasing the resistance exerted on the conductor to retain the conductor within the connection module 10.

Depending upon the insulation material, the shape of the restraint 90 may vary. The arch restraint 90 may be supported on one or both ends as at 94 and 96. The support at 96, which insures the proper position of the arch restraint 90 relative to the conductor 12, may be thinner or weaker to allow deflection upon insertion of the conductor 12. Also the support 94 may hold the arch restraint 90 in a position of interference with the conductor 12 to insure positive engagement with the insulation 15 when the module 10 is assembled. The arched restraints 90 may be disposed in opposing relation, one on each of the shells 46, 48 or the arches may be disposed in opposing relation and both mounted on the same shell 46 or 48. In this latter arrangement, it is advisable to position opposing pairs of restraints 90 in both the shells to insure maximum efficacy of the restraints 90.

Figure 9:
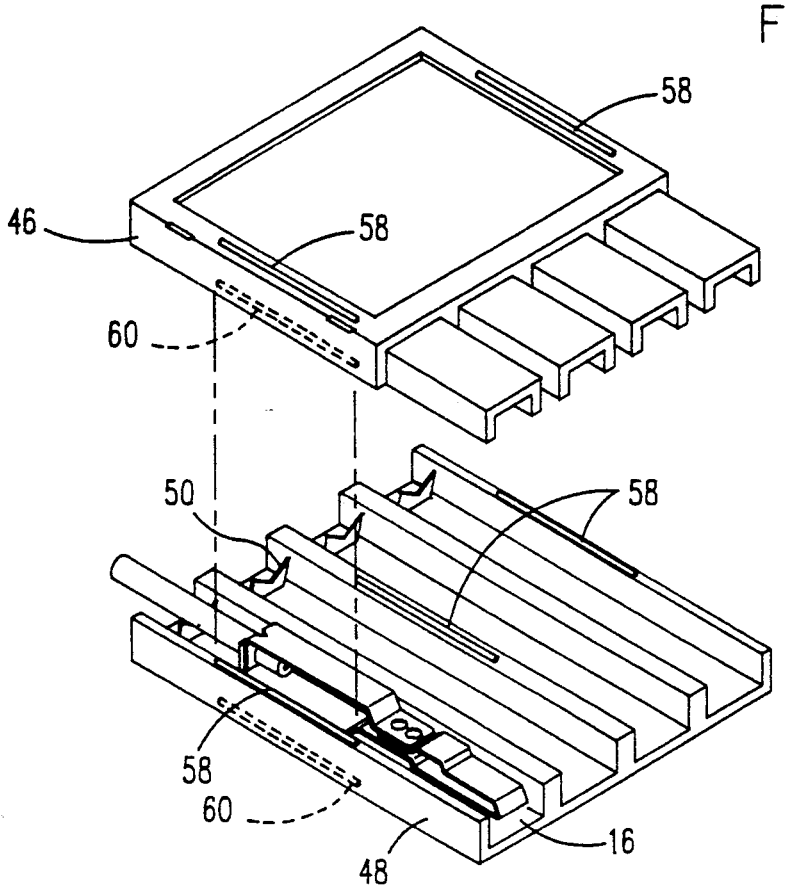
FIG. 9 illustrates exploded module shells illustrating a bead and groove snapped together retainer for retaining the shells and for retaining the modules in the larger assembly.
Figure 10:
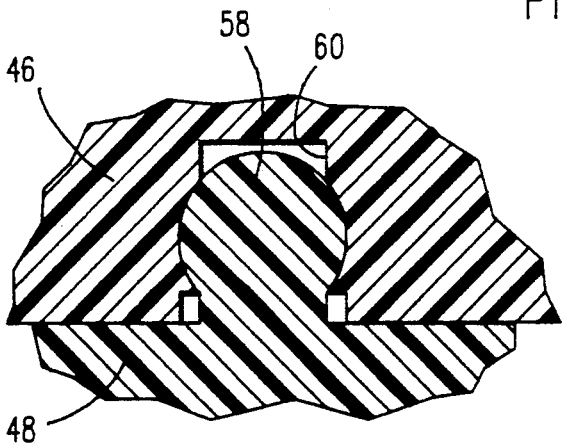
FIG. 10 is a sectional view of the bead and groove retainer.

The connection modules may be made with a relatively small number of openings 16 and then may have the modules stacked to form larger assemblies as illustrated in FIG. 8. By stacking the connection modules to form larger connection assemblies, larger numbers or multiples of conductors may be assembled and connected. For each in assembly of both the shells 46, 48 to form the connection module 10, and for assembling the connection modules 10 into the large plug assemblies 56, a bead and groove arrangement may prove to be beneficial. Referring to FIGS. 9 and 10, a bead of material may be formed during the molding of the bottom shell 48 and a groove 60 may be formed to overlie the bead 58. The dimensioning of the diameter of the bead and the width of the groove is such that there is an interference or snap engagement such that when the top shell 46 is mated with bottom shell 48 the bead is forced into the groove and retains the two shells 46, 48 as a unitary structure. If necessary for maintaining the shells 46, 48 in assembled condition, additional beads 58 and grooves 60 may be formed on mating surfaces of the shells 46, 48. Further, the bead 58 and groove 60 assembly arrangement may be extended so that the bead 58/groove 60 attachment technique may be also used to assembly multiple connection modules 10 to form the plug assembly 56.

It may be desirable to prevent all but selected connection modules from being mated thereby preventing erroneous or undesirable electrical connections when plugging together the connection modules. The U-channels 22, 24 may be molded as parts of the bottom shell 48 and top shell 46 respectively, or may be unitarily molded as a part of only one of the two shells 46, 48. If it is desired to key the respective connection modules so that only identically mating and coated connection modules may be plugged into the connection module 10, then a thin width of plastic may be molded between the two Unchannels 22, 24, at the corners which most closely approach the other channel 22, 24. This arrangement is best observed in FIG. 7 and more particularly FIG. *7a*. In FIG. *7a*, the bridge 66 is shown connected to U-channel 24. However, the bridge 66 may instead be connected to the U-channel 22, or may be divided with a portion connected to U-channel 22 and a portion connected to U-channel 24, or if the U-channels 22 and 24 are molded as a part of one of the shells 46 or 48, the bridge 66 may be connected to both of the U-channels 22 and 24. In the example illustrated, with four openings 16 illustrated in the connection module 10, there would be eight bridges extending from the U-channel 24 to the U-channel 22. If the bridges 66 are removed from four of the eight bridges and the pattern of removal is such that when considering the presence or absence of a bridge starting from left to right in FIG. 7 at bridges numbered one through eight for identification, the pattern is the exact opposite with the bridges remaining when scanned from right to left or bridges in positions eight through one. For example, if the bridges 66 are removed from positions one, three, four and seven, the pattern of bridges being present when considered from position eight and progressing toward position one is the same pattern as the bridges being removed from positions one and progressing through position eight. Accordingly, when an identical connection module 10 is reversed and inserted, the removed bridges 66 will accommodate the remaining bridges 66 in the complimentary positions.

Figures 4, 5, 6:
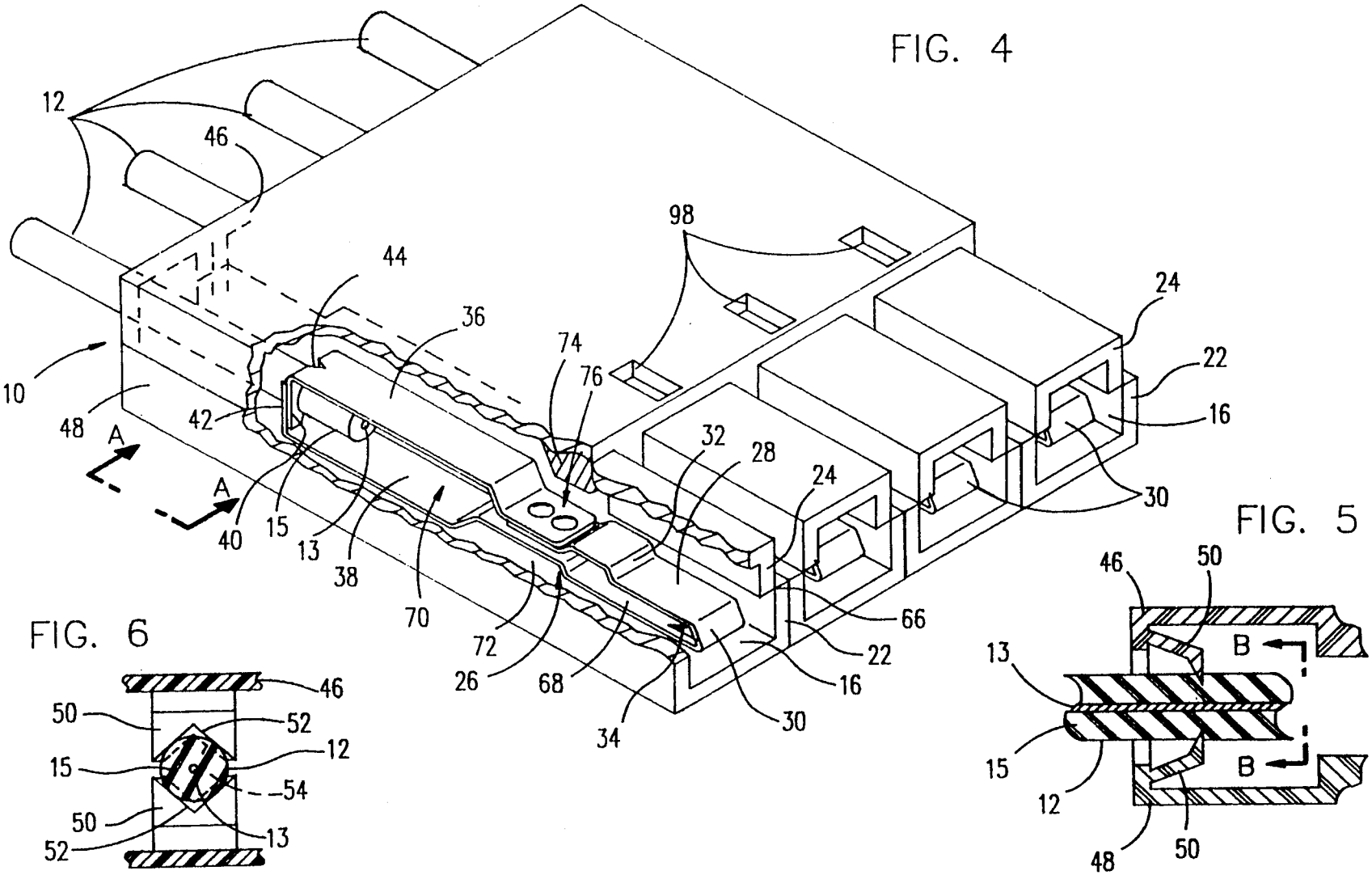
FIG. 4 is a broken-away view of one section of the module illustrating contact with the double captive insulation contacts and the strain relief, with the wire extending into the module.
FIG. 5 is a sectional view of the insulation displacement strain relief along section line A—A of FIG. 4.
FIG. 6 is a sectional view of the insulation displacement strain relief along section line B—B of FIG. 5.

The top shell 46 and bottom shell 48 are preferably injection molded plastic. The interior cavities formed by the assembly of the top and bottom shell 46, 48 preferably contain surfaces which will engage the junction points of the two loops, the contact loop 68 and the conductor engaging loop 70 as best shown in FIG. 4.

With engaging supports 72 and 74 approaching the other in the region of attachment 76 where the two loops 68 and 70 are joined, acts to position the contact assembly 26 longitudinally within the cavity formed by top shell 46 and bottom shell 48. Test probes may be inserted parallel to the conductor 12 to engage the rear end of legs 36 or 38 while another test probe may be inserted through opening 16 to engage either nose contact zone 30 or large contact zone 28 for testing purposes. An alternate arrangement for testing would be to utilize access holes or ports 98 formed into shell 46. It should be understood that analogous ports could be formed into shell 48 if desired. Ports 98 grant test probe access to the contact assembly 26 for electrical testing. Test access through port 98 allows testing the assembly connections between leg 36 and leg 70 at the junction at 76. This permits definitive testing of the insulation displacement connections with wire 13 at insulation displacement contact 44.

The same test port may be used to engage the contact assembly with a spot welder, soldering element or tool to complete the assembly of the contact assembly 26, if the parts of the contact assembly are loosely assembled in the connection module 10 and then joined together as with soldering or spot welding.

When two identical connection modules 10 are positioned in close proximity to one another and properly oriented one reversed to the other, then U-shaped channel 24 will be oriented to enter within Unchannel 22 on the other connection module 10 and upon forcible insertion the contact assemblies 26 will progressively make contact starting with the nose contact zones 30, and following with the large contact zone 28 followed still further with contact between at least one of the nose contact zones 30 and its mating stop contact zone 32.

It will become apparent to one of skill in the art that minor modifications and changes may be made to the preferred embodiment herein with departing from the scope or spirit of the attached claims.

I claim:

1. An electrical connector comprising:

a plurality of electrical conductors, each said conductor comprising a wire and a sheath of insulation surrounding said wire;

a pair of identical hermaphroditic shell assemblies mateable with each other and having an axis of insertion; said shell assemblies comprised of shell members; each of said shell assemblies contacting a contact member for engagement with an identical contact member in the other of said shell assemblies, said contact member comprises a pair of loops, said loops having ends and joined at one end of each of said loops, one of said loops having multiple angularly arranged contact surfaces including a planar contact surface disposed parallel to said axis, said surfaces exposed for engaging contact with corresponding contact surfaces of said other of said contact members;

said other of said loops comprising at least one insulation displacement engaging means for displacing insulation on a wire and for engaging said wire electrically, when forced against said wire.

2. The electrical connector of claim 1 wherein each said shell assembly comprises a pair of shell members disposed for face-to-face assembly, thereby forming an assembly defining a plurality of cavities and a hermaphroditic mating region.

3. The electrical connector of claim 2 wherein said hermaphroditic mating region comprises a male portion and a female portion of said shell which mate with an identical male and female portion, said male and female portions comprising a bridge means for bridging between said portions and for forming a plurality of blocking members, said blocking members arranged in a pattern, said pattern having two ends and an even number of member positions distributed around a mid point in said pattern, occupying blocking member positions as reckoned from one end of said pattern, where a blocking member does not occupy a corresponding position as reckoned from an opposite end of said pattern, whereby said shell assemblies may be mated only with shell assemblies which possess identical blocking member patterns.

4. The electrical connector of claim 1 wherein said contact members comprise a first loop of electrically conductive metal formed in a web of said metal folded back onto itself and said web attached to itself, said loop shaped to present a plurality of contact surfaces to an identical contact member in said other of said shell assemblies.

5. The electrical connector of claim 4 wherein said plurality of contact surfaces comprise a nose contact surface and a stop contact surface, each said nose and stop contact surfaces disposed parallel to the other of said nose and stop contact surfaces and inclined to said axis and said planar contact surface to intersect said axis and said planar surface forming an obtuse angle between said nose contact surface and said planar contact surface whereby said planar contact surfaces of both contact members engage and said nose contact surface of said other of said contact members, when said connector is fully assembled and each of said shell assemblies is fully engaged with the other of said shell assemblies, whereby said stop contact surface of one of said contact members engage said nose contact surface of said other of said contact members thereby preventing further insertion of one of said shell assemblies into/onto said other of said shell assemblies.

6. The electrical connector of claim 4 wherein said contact member of one of said shell assemblies electrically contacts said contact member of said other of said shell assemblies on at least two of said contact surfaces on each contact member.

7. The electrical connector of claim 1 comprising a strain relief, said strain relief comprising a compression member supported on at least one end by and projecting from said shell members and disposed projecting toward said conductor and toward said contact members and projecting into space occupied by said insulation of said conductor, for engagement with and compression of said insulation, and for compression by any movement of said conductor relative to said shell members, in a direction to separate said shell members from said conductors.

8. The electrical c of claim 7 wherein said compression member comprises a sharpened edge for cutting and engaging said insulation and said edge is relieved in a region to prevent contact with said wire.

9. The electrical connector of claim 1 wherein said other loop is joined to said first loop, said other loop comprising a pair of leg portions with terminating ends, each of said ends disposed toward the other of said terminating ends, each of said ends comprising an insulation displacement contact disposed for contact with said conductor and said wire when said ends are juxtaposed.

10. The electrical connector of claim 1 wherein one of said shell members of each of said shell assemblies carries, disposed on an exterior surface thereof, a bead member and said other of said shell members carries disposed on an exterior surface thereof, a groove disposed for mating engagement with said bead member, whereby said shell members may be attached to other shell members by forcing said bead member into said groove.

11. An electrical connector comprising:

a plurality of electrical conductors, each said conductor comprising a wire and a sheath of insulation surrounding said wire;

a pair of identical hermaphroditic shell assemblies mateable with each other and having an axis of insertion, said shell assemblies comprised of shell members;

each of said shell assemblies containing a contact member for engagement with an identical contact member in the other of said shell assemblies, said contact member comprises a pair of loops, said loops having ends and at one end of each of said loops, one of said loops having multiple angularly arranged contact surfaces including a planar contact surface disposed parallel to said axis, said surfaces exposed for engaging contact with corresponding contact surfaces of said other of said contact members;

said other of said loops comprising a pair of insulation displacement engaging contacts for displacing insulation on a wire and for engaging said wire electrically, when forced against said wire said pair of insulation displacement engaging contacts disposed opposed to each other to close on said wire form opposite sides;

said identical hermaphroditic shell assemblies each comprising a strain relief means for forcibly engaging and compressing said insulation of said wire, said strain relief means being integral with said assemblies and at least one member extending from an interior surface of one of said assemblies toward a position occupied by said wire and toward said one of said loops of said contact member.

12. The electrical connector as defined in claim 11 wherein said one of said loops of said contact member further comprises a pair of contact surfaces, a first surface of said pair of contact surfaces disposed on a closed end of said loop and a second surface of said pair of contact surfaces separated from said first surface by said planar contact surface and disposed for engagement by said first said first of said pair of contact surfaces upon full insertion of said pairs of identical assemblies.

13. The electrical connector of claim 12 wherein said first and second surfaces of said pair of contact surfaces are disposed at the same orientation relative to said planar contact surface and extending from opposite sides of said planar contact surface.

14. The electrical connector of claim 11 wherein said strain relief means comprises a pair of rigid blades, each said blade extending toward the other and having a length to engage and penetrate said insulation, upon closing said shell assemblies.

15. The electrical connector of claim 14 wherein said blades comprise a sharpened notched edge disposed to engage said insulation without engaging said wire.

16. The electrical connector of claim 11 comprising a bead disposed on a first surface of one of said shell assemblies and a groove disposed in a mating relation to said bead on a second surface of a second identical one of said shell assemblies for forcible engagement with said bead to trap said bead within said groove for retaining said assemblies in an assembled condition, thereby forming an assembly of said shell assemblies.

17. An electrical connector of the hermaphroditic type comprising two identical connector modules, each of said modules comprising two mating shells, said shell enclosing at least an electrical contact assembly, an electrical conductor comprising a wire and an insulation coating, and a strain relief; said electrical contact assembly comprising a flat web of conductive metal forming first and second loops, said first loop presenting at least three electrical contact regions thereon for engagement with three identical electrical contact regions on an identical electrical contact assembly; said second loop comprising a pair of legs of said web, each terminating in an insulation displacement connector for engaging said wire, said terminating ends disposed to engage said wire from opposite sides of said wire; said strain relief comprising at least a pair of rigid, sharp edged members extending toward said conductor from said shells, said sharp edges forcibly engaged with said insulation coating.

18. The electrical connector of claim 17, wherein said strain relief extends toward said wire and project in a direction which is toward said electrical contact assembly and said sharp edges are disposed to engage said insulation substantially perpendicular to said wire.

19. The electrical connector of claim 17 wherein said insulation displacement connectors trap said wire between said connectors and sever said insulation to form contacts with said wire.

20. The electrical connector of claim 17 wherein each of said electrical contact assemblies comprises three electrical contact regions at least two of said three regions simultaneously contacting two of said three regions on said mating contact assembly.

* * * * *